US005850664A

United States Patent [19]

Forsline

[11] Patent Number: 5,850,664

[45] Date of Patent: Dec. 22, 1998

[54] METHOD AND APPARATUS FOR CONSTRUCTING A PAINT APPLICATOR

[76] Inventor: Ladd B. Forsline, 16 Gehringer Dr., Kutztown, Pa. 19530

[21] Appl. No.: 851,861

[22] Filed: May 6, 1997

Related U.S. Application Data

[63] Continuation-in-part of Ser. No. 717,090, Sep. 20, 1996, Pat. No. 5,749,117.

[51] Int. Cl.[6] ..... B05C 17/00

[52] U.S. Cl. ..... 15/245.1; 15/188; 15/425; 132/320; 156/294

[58] Field of Search ..... 15/188, 245, 245.1, 15/192, 193, 204, 425; 156/91, 293, 294; 132/320

[56] References Cited

U.S. PATENT DOCUMENTS

| | | |
|---|---|---|
| 2,099,030 | 11/1937 | Morrison . |
| 2,147,310 | 2/1939 | Morrison . |
| 2,341,227 | 2/1944 | Mieth . |
| 2,861,371 | 11/1958 | Leshik . |
| 3,609,051 | 9/1971 | Brown . |
| 3,897,602 | 8/1975 | Brennenstuhl . |
| 4,083,078 | 4/1978 | Shimizu . |
| 4,521,456 | 6/1985 | Hanson . |
| 5,096,322 | 3/1992 | Shiga et al. . |
| 5,320,442 | 6/1994 | Yanagisawa et al. . |
| 5,328,011 | 7/1994 | Gueret . |
| 5,351,357 | 10/1994 | Liberman . |
| 5,542,144 | 8/1996 | Forsline . |

FOREIGN PATENT DOCUMENTS

| | | |
|---|---|---|
| 25 47 000 | 4/1976 | Germany . |

OTHER PUBLICATIONS

Sales catalog from Kemper Tools, the manufacturer of the "Wipe Out Tool", dated Sep. 1989.

Sax Arts and Crafts sales catalog, a distributor of the "Wipe Out Tool", dated winter of 1994.

*Primary Examiner*—Randall E. Chin

*Attorney, Agent, or Firm*—Patterson & Keough, P.A.

[57] ABSTRACT

A device for the application and manipulation of paint includes a handle having a distal end and a proximal end and a working tip. The working tip is comprised of a flexible, polymer material and has a proximal end that includes structure defining at least one aperture or channel. A cavity is located at the distal end of the handle into which the proximal end of the working tip is inserted. The working tip is secured in the cavity by a flowable adhesive material which at least partially penetrates the aperture or channel prior to curing. The cured adhesive material adheres to at least a portion of an interior surface of the cavity and forms solid pins in the apertures or corresponding ridges in the channels of the proximal end of the working tip, thereby securing the working tip within the cavity. Methods for creating a device in accordance with the present invention, either with or without a ferrule are also disclosed. Preferably, the working tip is made of silicone or a polymer material having surface release characteristics similar to silicone.

37 Claims, 6 Drawing Sheets

METHOD AND APPARATUS FOR CONSTRUCTING A PAINT APPLICATOR

RELATED APPLICATION

This application is a continuation-in-part of my prior application Ser. No. 08/717,090 filed on Sep. 20, 1996, now U.S. Pat. No. 5,749,117 entitled "Paint Applicator Having An Extruded Working Tip", a copy of which is attached and the disclosure of which is hereby incorporated by reference.

FIELD OF THE INVENTION

The present invention relates to the field of devices for the application and manipulation of paint or paint-like substances. In particular, the present invention relates to a method and apparatus for constructing a paint applicator having a handle and a working tip, and preferably a paint applicator in which the working tip is comprised of silicone or similar polymer materials.

BACKGROUND OF THE INVENTION

Since prehistoric times, people have used tools to apply and manipulate paint and paint-like materials. Bristled brushes to apply and manipulate paint have been known and in use for much of modern history. Traditionally, bristled brushes were formed from natural materials such as the hair of animals attached to a wooden handle by a metal ferrule or band that held the hairs together and which in turn was crimped to an end of the wooden handle. More recently, synthetic bristles have been used in place of animal hairs, and other techniques such as gluing and stapling have been developed to attach the ferrule to the handle of the brush. Alternative types of brushes and applicator tools have also been developed, such as sponge brushes and metal and rubber paint spatulas. For these types of tools, it is common to mold or glue the working tip around and onto the working end of the handle of the tool.

Recently, a new kind of paint applicator tool was developed which uses a silicone tip as the working tip of the tool to apply and manipulate paint and paint like materials. Because the working tip is made of silicone, the tool is more durable and easier to clean than conventional bristle brushes. This tool is described in my patent, U.S. Pat. No. 5,542,144. In this invention, a non-porous, impermeable silicone painting tip is attached to a conventional artist's paint brush handle by attaching a ferrule to the handle and expansively locking the silicone tip within the ferrule. In a preferred embodiment of this invention, the mechanism which expands the ferrule connecting portion of the silicone tip is described as an insert, such as a screw or barbed projection, which is installed in the ferrule connecting portion of the silicone tip to expand it within the ferrule.

The use of silicone or similar polymer materials as the working tip in this tool offers advantages over conventional bristle brushes because of the surface release characteristics of silicone which prevent paint and paint-like materials from permanently sticking to the tip. Unfortunately, the same characteristics which make silicone tips advantageous, also make the assembly and manufacture of this tool more complicated and expensive than the assembly and manufacture of conventional bristle brushes. In particular, for less expensive bristle brushes, it is known to glue the bristles into the ferrule and then attach the ferrule onto the handle, or to glue the bristles into a cavity formed in the handle, as a way to simplify the assembly and manufacturer of these brushes. With silicone tips, the surface release characteristics of the tip prevent most glues from working effectively. Additionally, the material characteristics of silicone and similar polymer-like materials do not lend themselves well to the technique of securing the silicone tip to the ferrule by crimping alone (in the manner in which an eraser is held on a pencil), this is because of the tendency of the silicone tip to work its way out of the ferrule and because of the relatively flimsy feel which is provided when the silicone tip is secured to the handle only by crimping.

Although silicone tip alternatives to conventional bristle brushes have been developed, the manner in which the silicone tip is attached to the handle may be more expensive and complicated than for conventional bristle brushes. Accordingly, it would be desirable to provide a new technique for attaching silicone or silicone-like tips to handles of paint applicator tools.

SUMMARY OF THE INVENTION

The present invention is device for application and manipulation of paint which includes a handle having a distal end and a proximal end and a working tip. The working tip is comprised of a flexible, polymer material and has a proximal end that includes structure defining at least one aperture or channel. A cavity is located at the distal end of the handle into which the proximal end of the working tip is inserted. The working tip is secured in the cavity by a flowable adhesive material which at least partially penetrates the aperture or channel prior to curing. The cured adhesive material adheres to at least a portion of an interior surface of the cavity and forms solid pins in the apertures or corresponding ridges in the channels of the proximal end of the working tip, thereby securing the working tip within the cavity. Methods for creating a device in accordance with the present invention, either with or without a ferrule are also disclosed. Preferably, the working tip is made of silicone or a polymer material having surface release characteristics similar to silicone.

A primary advantage of the present invention is the ability to more easily automate the manufacture of the device. Unlike existing techniques for securing silicone working tips within a ferrule, the present invention does not require that extra mechanical steps be performed in the assembly process. Moreover, the present invention solves the problems presented by the surface release characteristics of the silicone working tip which otherwise would effectively preclude the use of adhesives to secure the working tip to the ferrule or the handle. In addition, the use of an adhesive within the ferrule or handle can provide for a more secure attachment of the working tip than the existing mechanical attachments techniques.

BRIEF DESCRIPTIONS OF THE DRAWINGS

DETAILED DESCRIPTION OF THE PREFERRED EMBODIMENTS

Comprehension of the present invention can be gained through reference to the drawings in conjunction with a through review of the following explanation. In order to facilitate a full appreciation of the invention, an overview of the preferred embodiment is initially provided. The overview is followed by more detailed explanation and some significant alternative embodiments. By "paint" herein is meant not only oil based paint, but also acrylic paint, latex paint, polyurethane finishes, stains, watercolor paint, ink, charcoal and graphite and other such liquid, solid, emulsions, suspensions, and thixotropic substances applied to a range of substrates for artistic, decorative or protective purposes.

In a first embodiment, the present invention is a device primarily intended as an artist's or children's painting tool. For purposes of facilitating comprehension, it may be initially thought of as a substitute for the traditional well known bristle brush and its uses. However, it is easier to clean and allows novel results in use.

Figure 1:
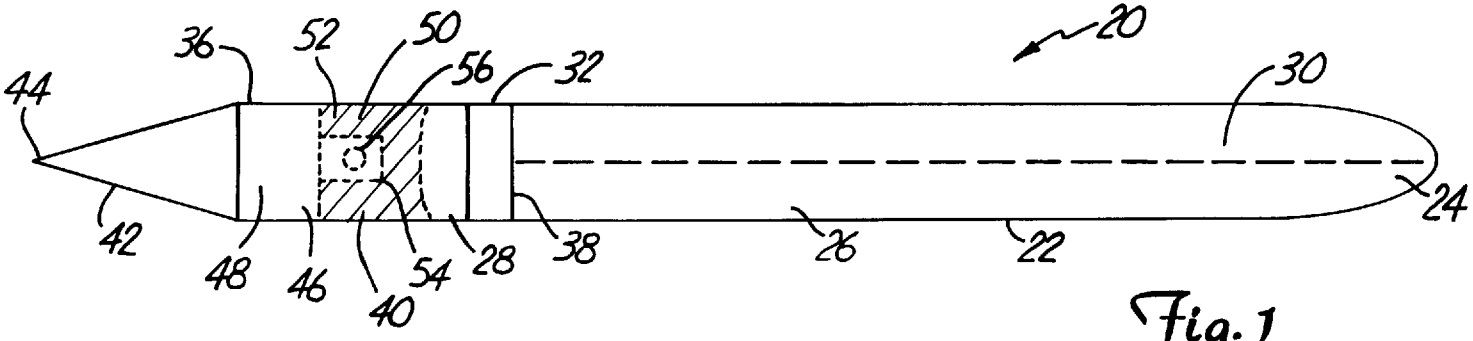
FIG. 1 is a perspective view of a paint applicator of the present invention showing a partial cutaway view of a proximal end of the working tip in a cavity in the handle.

As shown in FIG. 1, the device 20 has a handle 22 with a proximal end 24 and a distal end 26. As will be discussed later, the handle may be formed of wood, preferably varnished or lacquered hardwood, plastic or metal. Preferably, the handle 22 is similar to a conventional artist's bristle brush handle having a generally circular cross-section taken perpendicular to the longitudinal axis 30 of handle 22.

Attached to the distal end 26 of the handle 22 is a ferrule 28. The ferrule 28 is rigid and in a preferred embodiment may be steel, stainless steel, brass, copper or aluminum or a "nickel" plated brass to prevent corrosion or other suitable metallic materials. Suitable ferrules could also be formed of plastic. Preferably, the ferrule 28 is attached to the distal end 26 of the handle 22 by crimping, as represented by one or more crimps 32. Alternatively, the ferrule 28 could be attached to the handle by stapling, nailing, crimping, riveting, gluing or any combination thereof. The ferrule 28 preferably is circular tubular shaped corresponding to the cross-section shape of and extending beyond the distal end 26 of the handle 22. Most preferably, the ferrule 28 is slightly tapered and is narrower in cross section at its distal end 36 than its proximal end 38, although ferrule 28 can also be of uniform cross-sectional area throughout its length. The extension of ferrule 28 at distal end 36 defines a cavity 40. This cavity 40 lies adjacent to and extends longitudinally from the distal end 26 of the handle 22.

A resilient, flexible, working tip 42 is carried by cavity 40. Working tip 42 has a distal end 44 and a proximal end 46, the proximal end 46 being carried by cavity 40. In this embodiment, working tip 42 has a generally circular cross-section at a middle portion 48 defined between distal end 44 and proximal end 46 which corresponds to or is slightly larger than a cross section of distal end 36 of ferrule 28. The proximal end 46 of the working tip 42 has a cross-sectional area smaller than a cross-sectional area of the middle portion 48 of the working tip 42 such that a space for receiving a flowable adhesive material 50 is defined between the proximal end 46 of the working tip 42 and an interior surface of the cavity 40. Preferably, the working tip is inserted into the proximal end of the ferrule 28 and drawn through the taperal ferrule unti it extends from the distal end of the ferrule 28.

Figure 4:
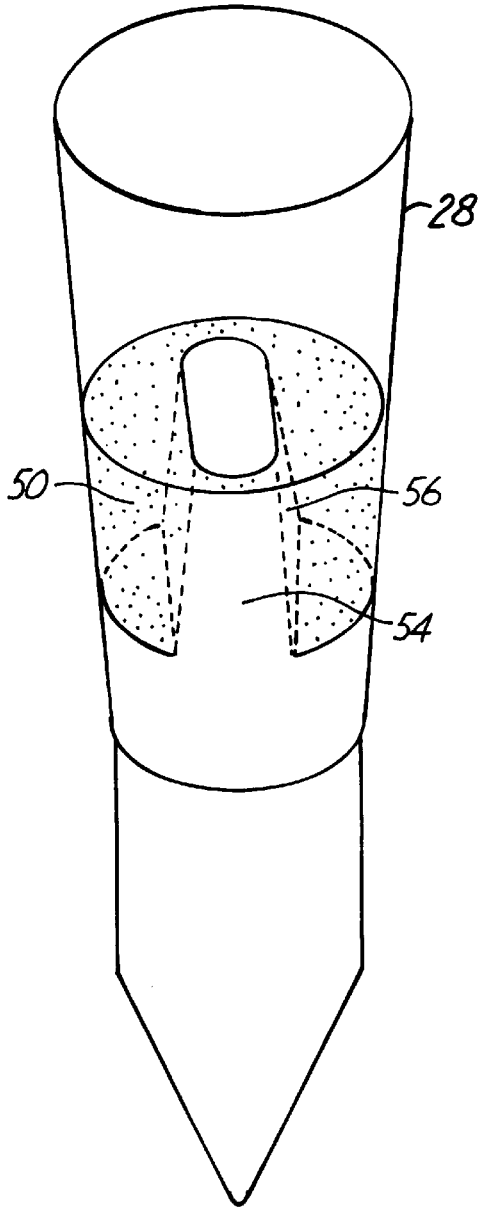
FIG. 4 is a more detailed perspective partial cutaway view of the working tip and ferrule of FIG. 1.
Figure 5:
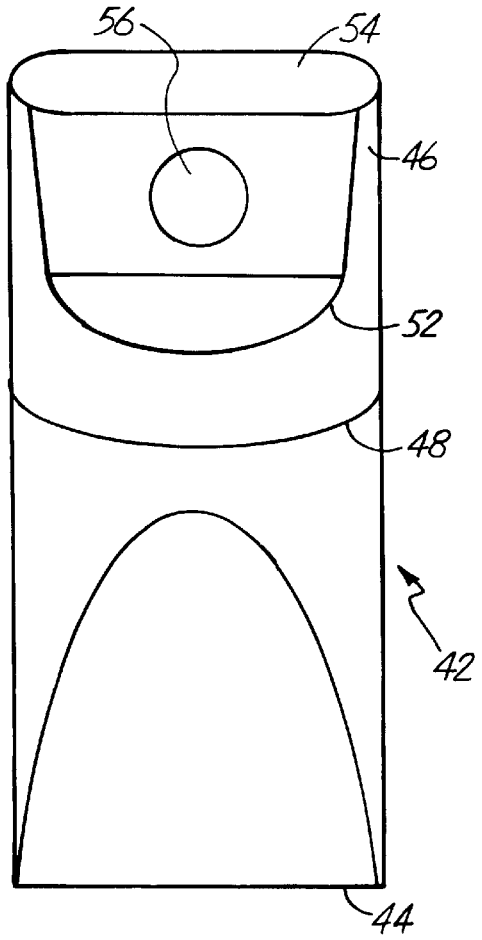
FIG. 5 is a side view of the working tip of FIG. 4.
Figure 8:
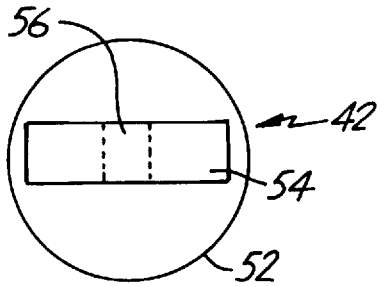
FIGS. 8–10 are end views of various embodiments of the proximal end of the working tip of the present invention.
Figure 9:
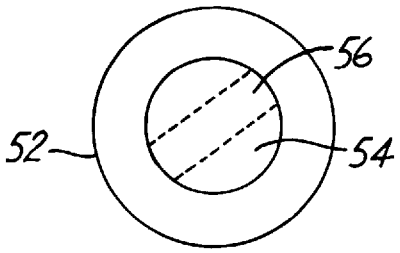
Figure 10:
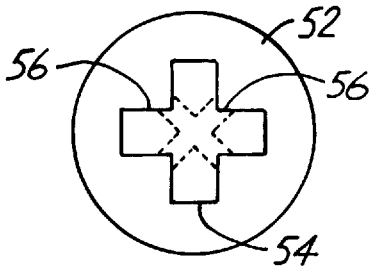

As shown in more detail in FIGS. 4 and 5, shoulder 52 is defined around a portion of the periphery of the working tip 42 between the proximal end 46 and the middle portion 48. On the proximal end 46 beyond the shoulder 52 is defined a tab 54 through which at least one aperture 56 is defined. Preferably, aperture 56 is defined in an orientation generally perpendicular to the longitudinal orientation 30 of the handle 22. Preferably, the tab 54 has a longitudinal cross-sectional shape selected from the set consisting of: a rectangle, a circle or a cross as shown in FIGS. 8–10. It will be recognized that combinations of these shapes can be used, such as L-shaped, U-shaped, J-shaped or V-shaped.

In the case where ferrule 28 is tapered, the flowable adhesive material 50 will form a pin within aperture 56 and also adhere to interior surface of the cavity 40 of ferrule 28. In this way, the pin transfers its dimensional stability from adhering to the interior surface of ferrule 28 to working tip 42. In addition, because ferrule 28 is tapered, the cured adhesive material 50 forms a plug which prevents the working tip 42 from being withdrawn from ferrule 28. In the case where ferrule 28 is straight, the cured adhesive material 50 forms the pins as described in apertures 56 and then secures itself to interior surface of cavity 40 of ferrule 28, thereby securing working tip 42 within the cavity 40.

Figure 2:
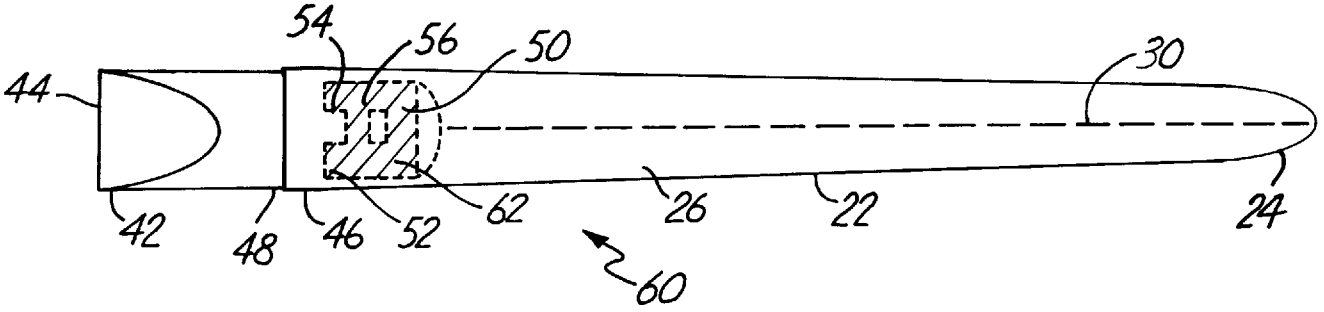
FIG. 2 is a perspective view of another paint applicator of the present invention showing a partial cutaway view of a proximal end of the working tip in a cavity in the ferrule.

FIG. 2 shows an alternate embodiment of a paint applicator 60 having a similar circular cross-sectional working tip 42 as shown in FIG. 1. In this embodiment, however, there is no ferrule 28 which defines a cavity 40. Instead, a longitudinally oriented cavity 62 is provided in the distal end 26 of handle 22. The working tip 42 is inserted into cavity 62 which is integral with handle 22, rather than cavity 40 which is defined by a ferrule 28. In all other respects, the operation and assembly of paint applicator 60 is similar to paint applicator 20 as shown in FIG. 1, and like elements have like reference numerals. This embodiment is particularly useful for less expensive paint applicators, such as children's paint applicators, in which the handle 22 is formed of a molded plastic material wherein the cavity 62 can simply be molded into the distal end 26.

Figure 3:
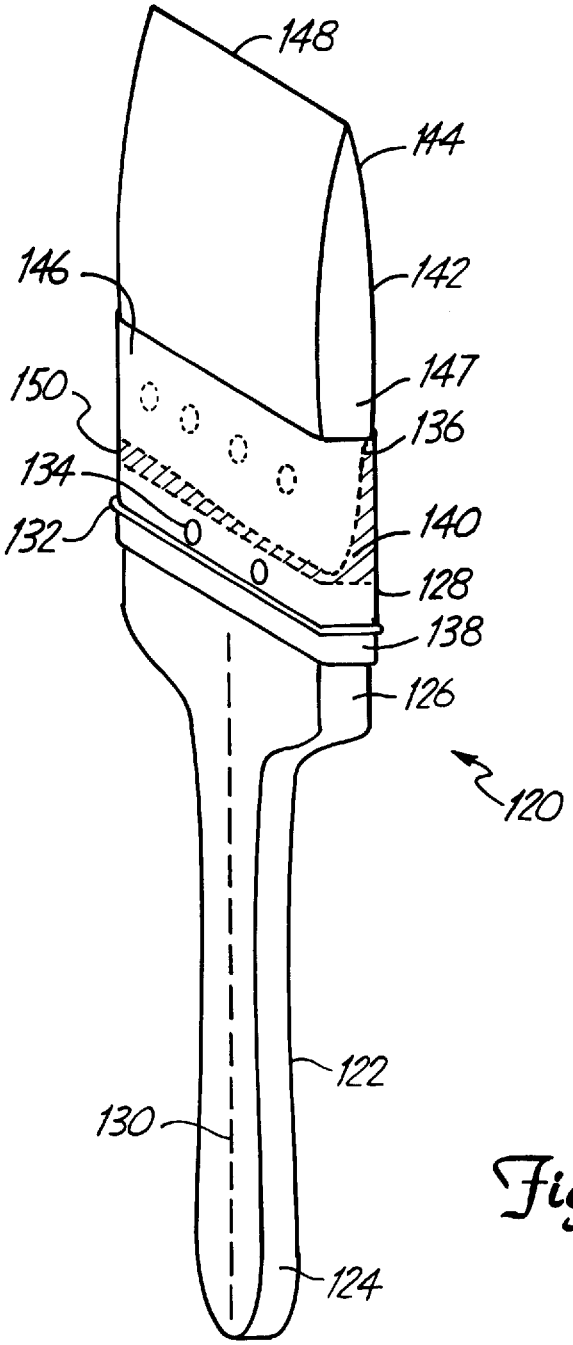
FIG. 3 is a perspective view of still another paint applicator of the present invention showing a partial cutaway view of the proximal end of a wide working tip in a cavity in the ferrule.

FIG. 3 shows another embodiment of the present invention having a wider working tip that is more suitable for application and manipulation of larger amounts of paint, such as interior and exterior house painting or the production of larger works of art. The device 120 has a handle 122 with a proximal end 124 and a distal end 126. The handle 122 may be formed of wood, preferably varnished or lacquered hardwood, plastic or metal. Preferably, the handle 122 is similar to a conventional house paint brush handle having a wider distal end 126 than the proximal end 124, with distal end 126 having a generally rectangular cross-section taken perpendicular to the longitudinal axis 130 of handle 122.

Figure 11:
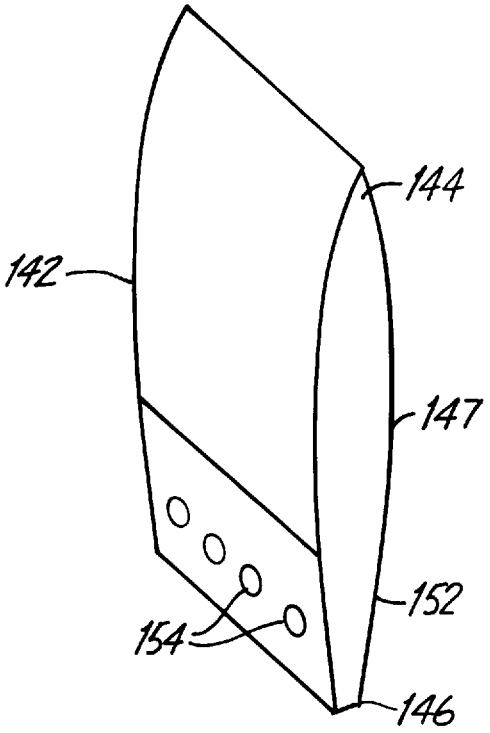
FIG. 11 is a more detailed perspective views of the working tip of FIG. 3.
Figure 12:
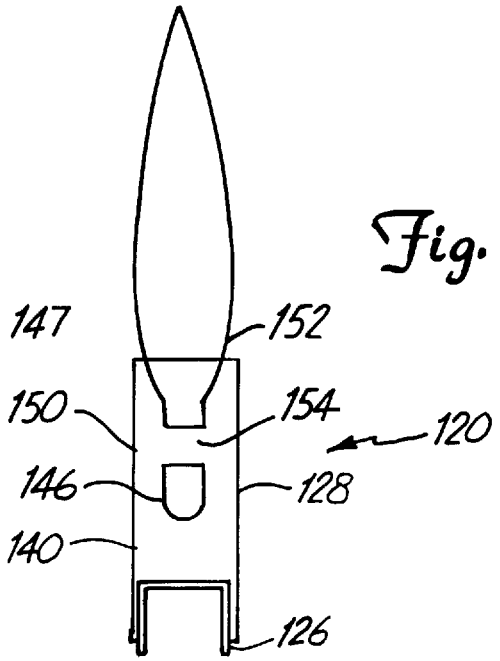
FIG. 12 is a cutaway side view of the working tip and ferrule of FIG. 3.

Attached to the distal end 126 of the handle 122 is a ferrule 128. The ferrule 128 is rigid and in a preferred embodiment may be steel, stainless steel, brass, copper or aluminum or a "nickel" plated brass to prevent corrosion or other suitable metallic materials. Suitable ferrules could also be formed of plastic. Preferably, the ferrule 128 is attached to the distal end 126 of the handle 122 by crimping, as represented by one or more crimps 132 and by rivets 134. Crimps 132 may also serve as structure support for ferrule 28. The ferrule 128 preferably is rectangular tubular shaped corresponding to the cross-section shape of and extending beyond the distal end 126 of the handle 122. Most preferably, the ferrule 128 is slightly tapered and is narrower in cross section at its distal end 136 than its proximal end 138. The extension of ferrule 128 at distal end 136 defines a cavity 140 as best seen in FIGS. 11 and 12. This cavity 140 lies adjacent to and extends longitudinally from the distal end 126 of the handle 122.

A resilient, flexible, working tip 142 is carried by cavity 140. Working tip 142 has a distal end 144 and a proximal end 146, the proximal end 146 being carried by cavity 140. Distal end 144 includes a distal working edge 148 being defined generally perpendicular to the longitudinal axis 130 of handle 122. Preferably, working tip 142 is generally rectangular in shape and has a longitudinal length of between 0.5" and 4.0", and a lateral width of between 0.25" and 4.0" and a thickness of between 0.1" and 1.0". Working tip 142 could be made in widths up to 12" wide. Because working tip 142 has dimensional characteristics generally similar to those of conventional bristle brushes in that the maximum lateral width of working tip 142 is generally not greater than a maximum lateral cross-sectional width of distal end 126 of handle 122. Preferably, working tip 142 is an extruded material formed by an extrusion process in which the distal working edge 148 is extruded parallel to a longitudinal orientation of the extrusion process and then cut generally perpendicular to the longitudinal orientation. Alternatively, working tip 142 may be individually cast, molded and/or cut pieces.

The proximal end 146 of the working tip 142 has a cross-sectional area smaller than a cross-sectional area of the middle portion 147 of the working tip 142 such that a space for receiving a flowable adhesive material 150 is defined between the proximal end 146 of the working tip 142 and an interior surface of the cavity 140. It should be noted that crimps 132 and rivets 134 may be positioned either proximal of the proximal end 146 of working tip 142, or crimps 132 and rivets 134 may be positioned so as to also aid in securing working tip 142 within ferrule 140.

As shown in more detail in FIGS. 11 and 12, shoulder 152 is defined around a portion of the periphery of the working tip 142 between the proximal end 146 and the middle portion 147. Unlike the shoulder 52 shown in FIG. 1, the shoulder 152 is more rounded in a preferred embodiment so as to assist in the insertion of working tip 142 within ferrule 140. On the proximal end 146 beyond the shoulder 152 are defined at least one aperture 154 in an orientation generally perpendicular to the longitudinal axis 130 of handle 122. Because of the larger width of working tip 142, it is preferably to use a plurality of apertures 154. In all other respects, the operation and assembly of paint applicator 120 is similar to paint applicator 20 as shown in FIG. 1.

Figure 6:
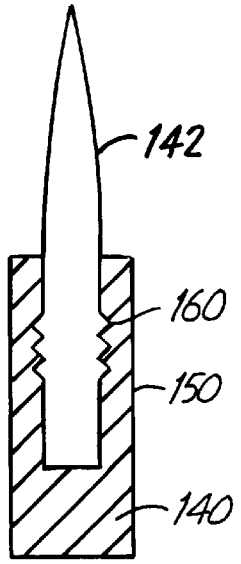
FIG. 6 is a cross-sectional view of an alternative embodiment for securing the working tip shown in FIG. 3.
Figure 7:
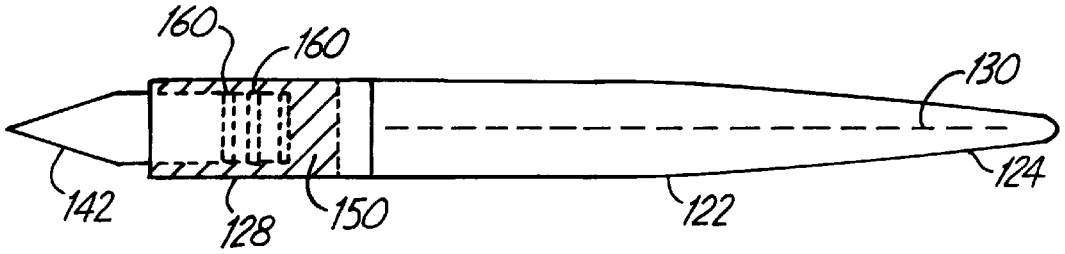
FIG. 7 is a perspective view of an alternate embodiment for securing the working tip shown in FIG. 1.

FIG. 6 shows an alternate embodiment of a wide paint applicator tool as shown in FIG. 3 and like elements have like reference numerals. In this embodiment, an adhesive 150 within ferrule 128 interacts with ridges 160 on the proximal end 146 of working tip 142. The ridges or channels 160 are oriented generally perpendicular to the longitudinal axis 130 of handle 122 in order to secure tip 142 within cavity 140 and prevent the withdrawal of working tip 142 from the ferrule 128. The channels 160 will cooperate with corresponding ridges of adhesive material 150 that will be created within cavity 140 when adhesive material 150 is cured to act like a plug preventing the withdrawal of working tip 142 from cavity 140 and also securing working tip 142 within cavity 140. FIG. 7 shows a similar alternate embodiment of a paint applicator tools as shown in FIG. 1 with ridges or channels 160.

The working tips 42, 142 are preferably formed of resilient silicone, although natural rubber, synthetic rubber, such as ethylene propylene or chloroprene rubber, PTFE, polyurethane, vinyl, soft plastics or any other impermeable, flexible rubber-like materials may be used as well. Preferably, working tips 42, 142 are made of a non-porous material or construction. A notable quality of all the serviceable materials are the surface release characteristics of the working tips 42, 142. Preferably, dry or drying paint does not appear to stick to the surface which results in remarkably easy cleaning of the tool tips after use. The preferred silicone is characterized by low compression set (i.e. forming tips which do not substantially relax over time even under constant pressure, thus allowing maintenance of the locking relationship within the ferrule over time without the use of adhesives which might deteriorate in the presence of solvents); a high tear strength (Die B, ppi ASTM 624 method) of about 50–250 (i.e. forming tips which show little tendency to rip or tear when an artist is actively painting); hardness, after cure, of from about 20–70, and preferably from about 30 to 60, Shore A durometer hardness (ASTM 2240 method), with 25–40 Shore A durometer hardness used to form "softer" tips, 45–60 Shore A durometer hardness material used to form "firmer" tips and 60–770 Shore A durometer hardness material used to form "extra firm" tips. Most preferably, the catalyst use to cure the preferred silicone is platinum based (which provides greater solvent resistance). However, less expensive peroxide based catalyst systems are believed to be acceptable to form less demanding tips as might be appropriately supplied to children.

A preferred source of such material is Medical Grade Silastic ETR™ Elastomers Q7-4735 and Q7-4750 (an enhanced tear resistant silicone) available from Dow Corning, with Q7-4735 being used to form "softer" tips and Q7-4750 being used to form "firmer" tips. These products are supplied as two-part thermal-setting elastomers. A related product, Q7-4765 is arguably serviceable but results in too "firm" a tip for most painting purposes, however, this material works well for sculpture or pottery materials such as clays, waxes and plasters. These three products are also blendable to formulate intermediate hardnesses and Q7-4765 may be useful, for example, in such blends. Less costly commercial products having identical or nearly identical properties to Q7-4735, Q7-4750 and Q7-4765 are also available from the manufacturer, as "medical grade" nature of these particular materials is somewhat expensive due to the additional quality control required to meet medical standards. Examples of these less costly materials include HS-30, HS-50 and HS-70, all of which are commercial grade, platinum based, one-part silicones. The Q7-4535 and Q7-4750 products are represented by Dow Corning as consisting of dimethyl and methylvinyl siloxane copolymers and reinforcing silica. Other silicones which are serviceable in the production of tips, yet somewhat less desirable are: fluorosilicones (very solvent resistant but substantially more costly); general purpose silastics such as GP-50 and GP-30 from Dow Corning (sufficient strength but less solvent resistant which prevents extensive applications with oil based paints but does allow use with childrens' paints); RTV (room temperature vulcanization types) from Dow Corning; LSR (liquid silicone rubber) such as LSR 595-HC and LSR 590.

Although only two types of form and edge are shown for working tips 42 and 142, a variety of forms and edges can be utilized in accordance with the present invention. For a description of the preferred types and constructions of working tips 42 and 142 which can be utilized with this embodiment of the present invention, reference is made to U.S. Pat. No. 5,542,144 and U.S. patent application Ser. No. 08/717,090, now U.S. Pat. No. 5,749,117 the disclosures of which are incorporated by reference herein.

The method of forming a device 20 in accordance with the present invention comprises the steps of:

a) providing a handle, the handle having a distal end and a proximal end;

b) providing a ferrule having a distal end and a proximal which defines a longitudinally-oriented cavity therebetween;

c) providing a working tip comprised of a flexible, nonporous polymer material and having a distal end and a proximal end;

d) creating at least one aperture in the proximal end of the working tip;

e) inserting the proximal end working tip into the distal end of the ferrule;

f) inserting a flowable adhesive material into the cavity in the ferrule;

g) attaching the ferrule with the working tip secured therein to the distal end of the handle; and h) curing the adhesive material such that the cured adhesive material adheres to at least a portion of an interior surface of the cavity and forms solid pins in the at least one aperture in the proximal end of the working tip, thereby securing the working tip within the ferrule.

The method of forming a device 60 in accordance with the present invention comprises the steps of:

a) providing a handle, the handle having a distal end and a proximal end with a longitudinally-oriented cavity defined therein;

b) providing a working tip comprised of a flexible, nonporous polymer material and having a distal end and a proximal end;

c) creating at least one aperture in the proximal end of the working tip;

d) inserting a flowable adhesive material into the cavity in the proximal end of the handle;

e) inserting the proximal end of the working tip into the cavity in the distal end of the handle; and f) curing the adhesive material such that the cured adhesive material adheres to at least a portion of an interior surface of the cavity and forms solid pins in the at least one aperture in the proximal end of the working tip, thereby securing the working tip within the cavity.

The method of forming a device 120 in accordance with the present invention comprises the steps of:

a) providing a handle, the handle having a distal end, a proximal end and a longitudinal axis;

b) providing a ferrule having a distal end and a proximal which defines a longitudinally-oriented cavity therebetween;

c) providing a working tip comprised of a flexible, nonporous polymer material and having a distal end and a proximal end;

d) creating at least one channel in the proximal end of the working tip, the channel being oriented generally perpendicular to the longitudinal axis of the handle;

e) inserting the proximal end working tip into the distal end of the ferrule;

f) inserting a flowable adhesive material into the cavity in the ferrule;

g) attaching the ferrule with the working tip secured therein to the distal end of the handle; and h) curing the adhesive material such that the cured adhesive material adheres to at least a portion of an interior surface of the cavity and forms ridges corresponding to the at least one channel in the proximal end of the working tip, thereby securing the working tip within the ferrule.

Providing apertures 56, 154 in the working tips 42, 142 can be accomplished by molding the working tip 42, 142 with at least one aperture 56, 154 extending through the proximal end 46, 146 of the working tip 42, 142 in an orientation generally perpendicular to a longitudinal orientation 30, 130 of the handle 22, 122. Alternatively, the apertures 56, 154 in the working tips 42, 142 can be accomplished by removing material from the working tip 42, 142 so as to define at least one aperture 56, 154 extending through the proximal end 46, 146 of the working tip 42, 142 in an orientation generally perpendicular to a longitudinal orientation 30, 130 of the handle 22, 122. Preferably, the material of working tip 42, 142 is removed to create apertures 56, 154 by a method selected from the set consisting of: cutting, punching, drilling, melting or any combination thereof.

In the methods for creating device 20 and 120 which include a ferrule 28, 128, steps (g) and (h) may be performed prior to step (f). The step (g) of securing the ferrule 28, 128 to the handle 22, 122 may be performed by an operation selected from the set of operations consisting of: stapling, nailing, crimping, riveting, gluing or any combination thereof.

Channels 160 for device 120 can be provided by molding the working tip 142 with at least one channel 160 extending around at least a portion of the periphery of the proximal end 146 of the working tip 142 in an orientation generally perpendicular to the longitudinal axis 130 of the handle 122. Alternatively, channels 160 can be provided by removing material from the working tip 142 so as to define at least one channel 160 extending around at least a portion of the periphery of the proximal end 146 of the working tip 142 in an orientation generally perpendicular to the longitudinal axis 130 of the handle 122.

In conclusion, it can be readily recognized that the present invention, in a number of embodiments provides a method and apparatus for constructing a paint applicator. Because numerous modifications may be made of this invention without departing from the spirit thereof, the scope of the invention is not to be limited to the single embodiment illustrated and described. Rather, the scope of the invention is to be determined by appended claims and their equivalents.

What is claimed is:

1. A device for application and manipulation of paint, comprising:

a handle having a distal end and a proximal end;

a working tip comprised of a flexible, polymer material having a proximal end including structure defining at least one aperture; and a cavity located at the distal end of the handle into which the proximal end of the working tip is inserted and secured by a flowable adhesive material which at least partially penetrates the at least one aperture prior to curing.

2. The device of claim 1 wherein the polymer material of the working tip is a material selected from the set consisting of: silicone rubber, natural rubber, synthetic rubber, PTFE, polyurethane, vinyl, soft plastics, impermeable, nonporous flexible rubber-like materials, or any combination thereof.

3. The device of claim 1 wherein the polymer material of the working tip has characteristics selected from the set consisting of: a durometer hardness value of between 20 Shore A to 70 Shore A, a tear strength value of between 50 to 250 Die B, a low compression set, or any combination thereof.

4. The device of claim 1 wherein the polymer material of the working tip possesses a surface release characteristic similar to silicone.

5. The device of claim 1 wherein the proximal end of the working tip has a cross-sectional area smaller than a cross-sectional area of a middle portion of the working tip such that a space for receiving the flowable adhesive material is defined between the proximal end of the working tip and the cavity.

6. The device of claim 1 wherein a shoulder is defined around a portion of the periphery of the working tip between the proximal end of the working tip and a middle portion of the working tip to define a tab at the proximal end through which the at least one apertures are defined in an orientation generally perpendicular to a longitudinal orientation of the handle.

7. The device of claim 6 wherein the tab has a longitudinal cross-sectional shape selected from the set consisting of: a rectangle, a circle, a cross or any combination thereof.

8. The device of claim 1 further comprising a ferrule which defines the cavity and wherein the distal end of the handle and a proximal end of the working tip are aligned coaxial within the ferrule without longitudinally overlapping and the ferrule is secured to the working tip by means selected from the set consisting of:

stapling, nailing, crimping, riveting, gluing or any combination thereof.

9. The device of claim 1 wherein the flowable adhesive material is an adhesive with a relatively thick viscosity selected from the set consisting of: hot melt polyester, polyamides and polyolefins, acrylics, epoxy, polysulfide or silicone.

10. The device of claim 1 wherein the cavity has a cross-sectional area which is selected from the set consisting of: longitudinally uniform or longitudinally tapered.

11. The device of claim 1 wherein the handle is formed of a plastic material and the cavity is defined in the distal end of the handle.

12. The device of claim 1 wherein the working tip and the handle are selected from the set consisting of: a working tip and a handle each having a generally circular cross-sectional area, or a working tip having a generally wide rectangular cross-sectional area and a handle having a matching wide rectangular cross-sectional area at the distal end and a narrower rounded cross-sectional area at the proximal end.

13. A device for application and manipulation of paint, comprising:

a handle having a distal end, a proximal end and a longitudinal axis;

a working tip comprised of a flexible, polymer material having a proximal end including structure defining at least one channel oriented generally perpendicular to the longitudinal axis of the handle; and a cavity located at the distal end of the handle into which the proximal end of the working tip is inserted and secured by a flowable adhesive material which is disposed between the channel and an interior surface prior to curing so as to secure the working tip by forming corresponding ridges of cured adhesive material within the cavity.

14. The device of claim 13 wherein the polymer material of the working tip is a material selected from the set consisting of: silicone rubber, natural rubber, synthetic rubber, PTFE, polyurethane, vinyl, soft plastics, impermeable, nonporous flexible rubber-like materials, or any combination thereof.

15. The device of claim 13 wherein the polymer material of the working tip has characteristics selected from the set consisting of: a durometer hardness value of between 20 Shore A to 70 Shore A, a tear strength value of between 50 to 250 Die B, a low compression set, or any combination thereof.

16. The device of claim 13 wherein the polymer material of the working tip possesses a surface release characteristic similar to silicone.

17. The device of claim 13 wherein the proximal end of the working tip has a cross-sectional area smaller than a cross-sectional area of a middle portion of the working tip such that a space for receiving the flowable adhesive material is defined between the proximal end of the working tip and the cavity.

18. The device of claim 13 further comprising a ferrule which defines the cavity and wherein the distal end of the handle and a proximal end of the working tip are aligned coaxial within the ferrule without longitudinally overlapping and the ferrule is secured to the working tip by means selected from the set consisting of: stapling, nailing, crimping, riveting, gluing or any combination thereof.

19. The device of claim 13 wherein the flowable adhesive material is an adhesive with a relatively thick viscosity selected from the set consisting of: hot melt polyester, polyamides and polyolefins, acrylics, epoxy, polysulfide or silicone.

20. The device of claim 13 wherein the cavity has a cross-sectional area which is selected from the set consisting of: longitudinally uniform or longitudinally tapered.

21. The device of claim 13 wherein the handle is formed of a plastic material and the cavity is defined in the distal end of the handle.

22. The device of claim 13 wherein the working tip and the handle are selected from the set consisting of: a working tip and a handle each having a generally circular cross-sectional area, or a working tip having a generally wide rectangular cross-sectional area and a handle having a matching wide rectangular cross-sectional area at the distal end and a narrower rounded cross-sectional area at the proximal end.

23. A method of forming a device for application and manipulation of paint, the method comprising the steps of:

a) providing a handle, the handle having a distal end and a proximal end with a longitudinally-oriented cavity defined therein;

b) providing a working tip comprised of a flexible, polymer material and having a distal end and a proximal end;

c) creating at least one aperture in the proximal end of the working tip;

d) inserting a flowable adhesive material into the cavity in the proximal end of the handle;

e) inserting the proximal end of the working tip into the cavity in the distal end of the handle; and f) curing the adhesive material such that the cured adhesive material adheres to at least a portion of an interior surface of the cavity and forms solid pins in the at least one aperture in the proximal end of the working tip, thereby securing the working tip within the cavity.

24. The method of claim 23 wherein step (c) is accomplished by molding the working tip with at least one aperture extending through the proximal end of the working tip in an orientation generally perpendicular to a longitudinal orientation of the handle.

25. The method of claim 23 wherein step (c) is accomplished by removing material from the working tip so as to define at least one aperture extending through the proximal end of the working tip in an orientation generally perpendicular to a longitudinal orientation of the handle.

26. The method of claim 25 wherein material is removed from the working tip by a method selected from the set consisting of: cutting, punching, drilling, melting or any combination thereof.

27. A method of forming a device for application and manipulation of paint, the method comprising the steps of:

a) providing a handle, the handle having a distal end and a proximal end;

b) providing a ferrule having a distal end and a proximal which defines a longitudinally-oriented cavity therebetween;

c) providing a working tip comprised of a flexible, polymer material and having a distal end and a proximal end;

d) creating at least one aperture in the proximal end of the working tip;

e) inserting the proximal end working tip into the distal end of the ferrule;

f) inserting a flowable adhesive material into the cavity in the ferrule;

g) attaching the ferrule with the working tip secured therein to the distal end of the handle; and h) curing the adhesive material such that the cured adhesive material adheres to at least a portion of an interior surface of the cavity and forms solid pins in the at least one aperture in the proximal end of the working tip, thereby securing the working tip within the ferrule.

28. The method of claim 27 wherein step (d) is accomplished by molding the working tip with at least one aperture extending through the proximal end of the working tip in an orientation generally perpendicular to a longitudinal orientation of the handle.

29. The method of claim 27 wherein step (d) is accomplished by removing material from the working tip so as to define at least one aperture extending through the proximal end of the working tip in an orientation generally perpendicular to a longitudinal orientation of the handle.

30. The method of claim 29 wherein material is removed from the working tip by a method selected from the set consisting of: cutting, punching, drilling, melting or any combination thereof.

31. The method of claim 27 wherein steps (g) and (h) are performed prior to step (f).

32. The method of claim 27 wherein step (g) is performed by an operation selected from the set of operations consisting of: stapling, nailing, crimping, riveting, gluing or any combination thereof.

33. A method of forming a device for application and manipulation of paint, the method comprising the steps of:

a) providing a handle, the handle having a distal end, a proximal end and a longitudinal axis;

b) providing a ferrule having a distal end and a proximal which defines a longitudinally-oriented cavity therebetween;

c) providing a working tip comprised of a flexible, polymer material and having a distal end and a proximal end;

d) creating at least one channel in the proximal end of the working tip, the channel being oriented generally perpendicular to the longitudinal axis of the handle;

e) inserting the proximal end working tip into the distal end of the ferrule;

f) inserting a flowable adhesive material into the cavity in the ferrule;

g) attaching the ferrule with the working tip secured therein to the distal end of the handle; and h) curing the adhesive material such that the cured adhesive material adheres to at least a portion of an interior surface of the cavity and forms ridges corresponding to the at least one channel in the proximal end of the working tip, thereby securing the working tip within the ferrule.

34. The method of claim 33 wherein step (d) is accomplished by molding the working tip with at least one channel extending around at least a portion of the periphery of the proximal end of the working tip in an orientation generally perpendicular to the longitudinal axis of the handle.

35. The method of claim 33 wherein step (d) is accomplished by removing material from the working tip so as to define at least one channel extending around at least a portion of the periphery of the proximal end of the working tip in an orientation generally perpendicular to the longitudinal axis of the handle.

36. The method of claim 33 wherein steps (g) and (h) are performed prior to step (f).

37. The method of claim 33 wherein step (g) is performed by an operation selected from the set of operations consisting of: stapling, nailing, crimping, riveting, gluing or any combination thereof.

* * * * *